US007880135B2

(12) United States Patent
Umemura

(10) Patent No.: US 7,880,135 B2
(45) Date of Patent: Feb. 1, 2011

(54) MASS SPECTROMETER

(75) Inventor: Yoshikatsu Umemura, Osaka (JP)

(73) Assignee: Shimadzu Corporation, Kyoto (JP)

( * ) Notice: Subject to any disclaimer, the term of this patent is extended or adjusted under 35 U.S.C. 154(b) by 437 days.

(21) Appl. No.: 12/094,426

(22) PCT Filed: Jun. 27, 2006

(86) PCT No.: PCT/JP2006/312771

§ 371 (c)(1),
(2), (4) Date: May 21, 2008

(87) PCT Pub. No.: WO2007/060760

PCT Pub. Date: May 31, 2007

(65) Prior Publication Data

US 2009/0166522 A1 Jul. 2, 2009

(30) Foreign Application Priority Data

Nov. 22, 2005 (JP) ..... 2005-336449

(51) Int. Cl.
*H01J 49/26* (2006.01)

(52) U.S. Cl. ..... 250/281; 250/282; 422/68.1; 702/27

(58) Field of Classification Search ..... None
See application file for complete search history.

(56) References Cited

U.S. PATENT DOCUMENTS

| | | | | |
|---|---|---|---|---|
| 7,544,931 | B2 * | 6/2009 | Yamaguchi et al. | 250/282 |
| 2005/0063864 | A1 * | 3/2005 | Sano et al. | 422/68.1 |
| 2005/0234651 | A1 | 10/2005 | Tanaka et al. | |
| 2009/0026360 | A1 * | 1/2009 | Yamauchi et al. | 250/281 |
| 2009/0072132 | A1 * | 3/2009 | Manri et al. | 250/282 |
| 2010/0228498 | A1 * | 9/2010 | Yamauchi et al. | 702/27 |

FOREIGN PATENT DOCUMENTS

| | | | |
|---|---|---|---|
| EP | 1 467 397 | A2 | 10/2004 |
| JP | 61-020856 | A | 1/1986 |
| JP | 10-293120 | A | 11/1998 |
| JP | 11-064285 | A | 3/1999 |

(Continued)

*Primary Examiner*—Jack I Berman
(74) *Attorney, Agent, or Firm*—Sughrue Mion, PLLC

(57) ABSTRACT

The analyst previously enters the mass of a fragment that desorbs in the first dissociation with other analysis conditions, as the precursor ion selection reference for the second dissociation through the input unit 25. When the automatic analysis is started, the controller unit 21 sequentially performs the $MS^1$ analysis, $MS^2$ analysis and $MS^3$ analysis. In the course of these analyses, the data processing unit 23 determines the valence of each ion species corresponding to the peaks appearing in the mass spectrum obtained by the $MS^1$ analysis. In addition, after the $MS^2$ analysis, the data processing unit 23 searches for the ion species in conformity with the selection reference in consideration of the determined valence, among the ion species corresponding to the peaks appearing in the mass spectrum by the $MS^2$ analysis. The selected ion is determined as the precursor ion for the second dissociation in the $MS^3$ analysis. In this manner, regardless of the valence of the target ion, the precursor ions to be selected and dissociated in each stage of the $MS^n$ analysis are automatically selected according to the mass of the fragment desorbed in the dissociation in the previous stage. Therefore, the analytical efficiency is improved and the highly accurate chemical structure information can be obtained.

16 Claims, 4 Drawing Sheets

FOREIGN PATENT DOCUMENTS

| | | | |
|---|---|---|---|
| JP | 2000-171442 | A | 6/2000 |
| JP | 2004-257922 | A | 9/2004 |
| JP | 2004-259452 | A | 9/2004 |
| JP | 2005-265697 | A | 9/2005 |
| JP | 2005-300420 | A | 10/2005 |
| WO | 2005-090963 | A1 | 9/2005 |

* cited by examiner

MASS SPECTROMETER

CROSS REFERENCE TO RELATED APPLICATIONS

This application is a National Stage of International Application No. PCT/JP2006/312771 filed on Jun. 27, 2006, claiming priority based on Japanese Patent Application No. 2005-336449, filed Nov. 22, 2005, the contents of all of which are incorporated herein by reference in their entirety.

TECHNICAL FIELD

The present invention relates to a mass spectrometer, and more specifically to a mass spectrometer capable of mass-analyzing product ions produced by selecting and dissociating ions to be analyzed in multiple stages.

BACKGROUND ART

One of the well-known mass-analyzing methods using an ion trap mass spectrometer or other apparatuses is an MS/MS analysis (or tandem analysis). In a general MS/MS analysis, an ion species having a specific mass (mass-to-charge ratio m/z) is first selected as a precursor ion from ionic species produced from a sample including the substance to be analyzed. Next, the precursor ion thus selected is dissociated into product ions by a CID (Collision Induced Dissociation) process. This is the first selection/dissociation operation of the ionic species. The product ions thus created are separated according to their mass and detected as in a normal MS analysis. Ion species derived from some kind of substances show characteristic dissociations by CID process; hence it is possible to obtain the information on the chemical structure or other properties of the substance to be analyzed by focusing on the portion where the dissociation took place for example.

In recent years, such mass spectrometers are being used more and more in the fields of biochemistry, medical care or pharmaceutical chemistry, and other fields. Accordingly, substances having larger molecular weight than before, e.g. protein, peptide, lipid, are becoming analyzed. Their chemical structure (composition) also tends to become more complicated. Hence, depending on the quality of the substance to be analyzed, ions often are not dissociated to have a sufficiently small mass by a single selection/dissociation operation. In such cases, one effective analysis method would be an $MS^n$ analysis ($n \geqq 3$) in which a selection/dissociation operation is repeated more than once and the product ions finally generated are mass analyzed. If the selection/dissociation operation is performed only once in an MS/MS analysis, as described earlier, it is called an $MS^2$ analysis. That is, in an $MS^n$ analysis, the selection/dissociation operation is repeated n−1 times.

In such an $MS^n$ analysis, it is necessary to previously determine, before beginning an analysis, an ionic species (precursor ion) as a target for each of the first, second, . . . , and $(n-1)^{th}$ selection/dissociation operations. Conventionally, in general, such selection of a precursor ion for each stage is often performed by the analyzer by analyzing the data obtained through the analysis. Hence, in the case where an $MS^n$ analysis with multiple stages of ion species' selection/dissociation operation is performed, the analyzer has to analyze the same sample many times while considering and changing the analysis condition. This is a very troublesome operation and lowers the analytical efficiency.

In order to ease such a troublesome operation, some known mass spectrometers have the function of automatic selection of a precursor ion in an $MS^n$ analysis. In the mass spectrometer described in Patent Document 1, for example, from a plurality of peaks appearing in a mass spectrum obtained by an $MS^{n-1}$ analysis, an ion species corresponding to a peak with the highest signal intensity is selected as the precursor ion for the $(n-1)^{th}$ ion species' selection/dissociation operation in an $MS^n$ analysis. In the mass spectrometer described in Patent Document 2, a precursor ion for the $(n-1)^{th}$ ion species' selection/dissociation operation in an $MS^n$ analysis is determined in view of not only the peak having the highest signal intensity among a plurality of peaks appearing in a mass spectrum obtained by an $MS^{n-1}$ analysis, but also other peaks.

Such mass spectrometers having an automatic precursor ion selection function save the analyst the trouble of examining the analysis data each time to select the precursor ion. However, each of such mass spectrometers determines a precursor ion based on the information of a single mass spectrum. Therefore, for example, even in a case where it is known that a specific fragment is desorbed by a dissociation, it is not possible to focus attention on an ion generated by the desorption and select it as a precursor ion in an analysis.

On the other hand, conventionally-known triple stage quadrupole mass spectrometers capable of an MS/MS analysis employ measurement methods such as a precursor ion scan for detecting all the precursor ions that produce a specific product ion, and a neutral loss scan for detecting all the precursor ions that desorb a specific neutral fragment (neutral species). The feature of such methods is to specifically detect only a precursor ion having a particular product ion and/or a neutral loss. However, such mass spectrometers cannot perform an $MS^n$ analysis of $n \geqq 3$, and therefore cannot collect the sufficient information necessary for a structural analysis. In addition, if an ion is multivalent, accurate information cannot be obtained because it is sometimes difficult to distinguish different kinds of fragments desorbed from an ion, although this problem does not occur when the ion is monovalent.

[Patent Document 1] Japanese Unexamined Patent Application Publication No. 2000-171442

[Patent Document 2] Japanese Unexamined Patent Application Publication No. 2004-257922

DISCLOSURE OF THE INVENTION

Problem to be Solved by the Invention

In a structural analysis of a substance in the field of biochemistry or other fields, in particular, one approach to deduce the structure of a target substance is chemically modifying a target substance with a certain specified substance and then studying the region where the specified substance is bonded. In such an application, it would be very useful if a precursor ion could be selected in the $(n-1)^{th}$ selection/dissociation operation in an $MS^n$ analysis by focusing attention on the relationship between the precursor ion and product ions in the previous stage, i.e. in the $(n-2)^{th}$ selection/dissociation operation.

The present invention is accomplished in view of such problems and the objective thereof is to provide a mass spectrometer capable of an $MS^n$ analysis, in which an analysis can be performed by automatically selecting a precursor ion for the subsequent stage by paying attention to the relationship between the precursor ion and product ions of the previous stage, and particularly in which an $MS^n$ analysis can be carried out, as for multivalent ions as well, by properly selecting a precursor ion desired in accordance with the analyst's intention.

Means for Solving the Problems

The first aspect of the present invention achieved to solve the previously described problems provides a mass spectrometer capable of an $MS^n$ analysis ($n \geqq 3$), including:

a) an input section for allowing an analyst to enter and set a mass difference or information corresponding thereto between a precursor ion in an $(n-2)^{th}$ ion species' selection/dissociation operation and product ions created thereby, as a selection reference for a precursor ion of an $(n-1)^{th}$ ion species' selection/dissociation operation;

b) a valence determiner for determining a valence of at least one of selected precursor ions; and c) a precursor ion selector for searching for an ion species adapted to the selection reference entered and set through the input section, when performing an $MS^n$ analysis, in consideration of a valence determined by the valence determiner as to one of previous precursor ions, from among ion species corresponding to a peak appearing in a mass spectrum obtained by an $MS^{n-1}$ analysis, and then determining the ion species as a precursor ion of an $(n-1)^{th}$ ion species' selection/dissociation operation in the $MS^n$ analysis.

The second aspect of the present invention achieved to solve the previously described problems provides a mass spectrometer capable of an $MS^n$ analysis ($n \geqq 3$), including:

a) an input section for allowing an analyst to enter and set a mass difference or information corresponding thereto, and a valence difference or information corresponding thereto between a precursor ion in an $(n-2)^{th}$ ion species' selection/dissociation operation and a product ion created thereby, as a selection reference for a precursor ion of an $(n-1)^{th}$ ion species' selection/dissociation operation;

b) a valence determiner for determining a valence of an ion species corresponding to a peak appearing in a mass spectrum obtained by an analysis; and c) a precursor ion selector for searching for an ion species adapted to the selection reference entered and set through the input section, when performing an $MS^n$ analysis, in consideration of each of valences determined by the valence determiner as to a precursor ion and product ions in an $(n-2)^{th}$ ion species' selection/dissociation operation, from among ion species corresponding to a peak appearing in a mass spectrum obtained by an $MS^{n-1}$ analysis, and then determining the ion species as a precursor ion of an $(n-1)^{th}$ ion species' selection/dissociation operation in the $MS^n$ analysis.

The first and second aspects of the present invention includes, in a typical configuration, an ionization unit for ionizing a target substance; a mass separation unit for separating product ions, according to their mass, which were generated as a consequence of repeating a plurality of stages of selection/dissociation operation in which an ion species having a specific mass from among the ion species generated by the ionization unit is selected and dissociated; and a detection unit for detecting the ions dissociated by the mass separation unit, wherein an $MS^1$ analysis, $MS^2$ analysis, . . . and $MS^n$ analysis can be sequentially performed as a series of automatic analyses.

That is, in the case where $n=3$, an $MS^1$ analysis, $MS^2$ analysis and $MS^3$ analysis are sequentially performed as a series of automatic analyses. In the mass spectrometer according to the first aspect of the present invention, prior to the automatic analysis, the analyst enters and sets a mass difference or information corresponding thereto between the precursor ion in the first ion species' selection/dissociation operation and the product ion created thereby, as a selection reference for a precursor ion of the second ion species' selection/dissociation operation. In practice, various analysis conditions, e.g. the mass measurement range, may also be set in addition to the aforementioned ones when the selection reference or other conditions for the precursor ion in the first ion species' selection/dissociation operation are set. In the mass spectrometer according to the second aspect of the present invention, a valence difference or the information corresponding thereto is entered other than the mass difference or information corresponding thereto between the precursor ion in the first ion species' selection/dissociation operation and the product ion created thereby.

When the automatic analysis is started, an $MS^1$ analysis, $MS^2$ analysis and $MS^3$ analysis are sequentially performed under the analysis conditions entered as previously described or predetermined. When the $MS^1$ analysis is finished in the process, the valence determiner determines the valence of one or plural ion species corresponding to the peak appearing in the mass spectrum obtained by the $MS^1$ analysis. When the $MS^2$ analysis is finished, the precursor ion selector searches for an ion species that is adapted to the selection reference set by the analyst, in consideration of the valence determined by the valence determiner, from among the ion species corresponding to the peak appearing in the mass spectrum obtained by the $MS^2$ analysis. Under the premises that the fragments' desorption by a dissociation is a neutral loss, the valence of the precursor ion in the first selection/dissociation operation in an $MS^2$ analysis is maintained also by the product ions generated therefrom. By taking this valence into consideration, therefore, it is possible to find out an ion whose fragment desorbed has a certain mass even though it is a multivalent ion, and select the precursor ion in accordance with the analyst's intention.

Effect of the Invention

Hence, in the mass spectrometers according to the first and second aspects of the present invention, by paying attention to the relationship between the precursor ion and the product ions in the previous stage's selection/dissociation operation in an $MS^n$ analysis, the ion having a desired relationship is automatically selected as the precursor ion for the next stage to perform an analysis. In this process, the analyst only has to enter a selection reference focusing only on the relationship between the precursor ion and the product ions, completely without regard to the valence of ions. Regardless of whether the ion is monovalent or multivalent, i.e. regardless of the valence, the ion whose fragments desorbed by a dissociation accord with the analyst's intention is selected and the analysis is automatically performed. This provides critical information for deducing the chemical structure or composition with high accuracy.

The kind of the information that the analyst enters through the input section may vary. In an example, the input section may be for allowing the analyst to numerically enter the mass, or the mass and the valence, of a fragment desorbed in the $(n-2)^{th}$ ion species' selection/dissociation operation, as the selection reference for a precursor ion of the $(n-1)^{th}$ ion species' selection/dissociation operation.

In another aspect of the present invention, the input section may be for allowing the analyst to enter the composition formula, or the composition formula and valence or ionic formula of a fragment desorbed in the $(n-2)^{th}$ ion species' selection/dissociation operation, as the selection reference for a precursor ion of the $(n-1)^{th}$ ion species' selection/dissociation operation, and the mass spectrometer further includes a converter for calculating the mass or valence of the fragment from the information entered and set through the input section.

In this case, there is no problem as long as the composition formula is simple. However, if it is complicated, entering it through a keyboard operation is troublesome. Hence, preferably, the input section may be for allowing the analyst to select one from among a plurality of previously registered composition formulas and names, or a plurality of previously registered composition formulas and ionic formulas accompanied with valence.

EXPLANATION OF NUMERALS

10 . . . Separation/Detection Unit
11 . . . Ionization Unit
12 . . . Three-Dimensional Quadrupole Ion-Trap Mass Spectrometer Unit
13 . . . Time-Of-Flight Mass Spectrometer Unit
14 . . . Ion Detector
20 . . . Controlling/Processing Unit
21 . . . Controller Unit
22 . . . Analysis Condition Memory Unit
23 . . . Data Processing Unit
24 . . . Data Memory Unit
25 . . . Input Unit
26 . . . Display Unit

BEST MODE FOR CARRYING OUT THE INVENTION

Hereinafter, as an embodiment of the mass spectrometer according to the present invention, an explanation will be made for an ion-trap time-of-flight mass spectrometer, which is a combination of an ion trap (IT) and a time-of-flight mass spectrometer (TOF-MS), with reference to FIGS. 1 through 5.

Figure 1:
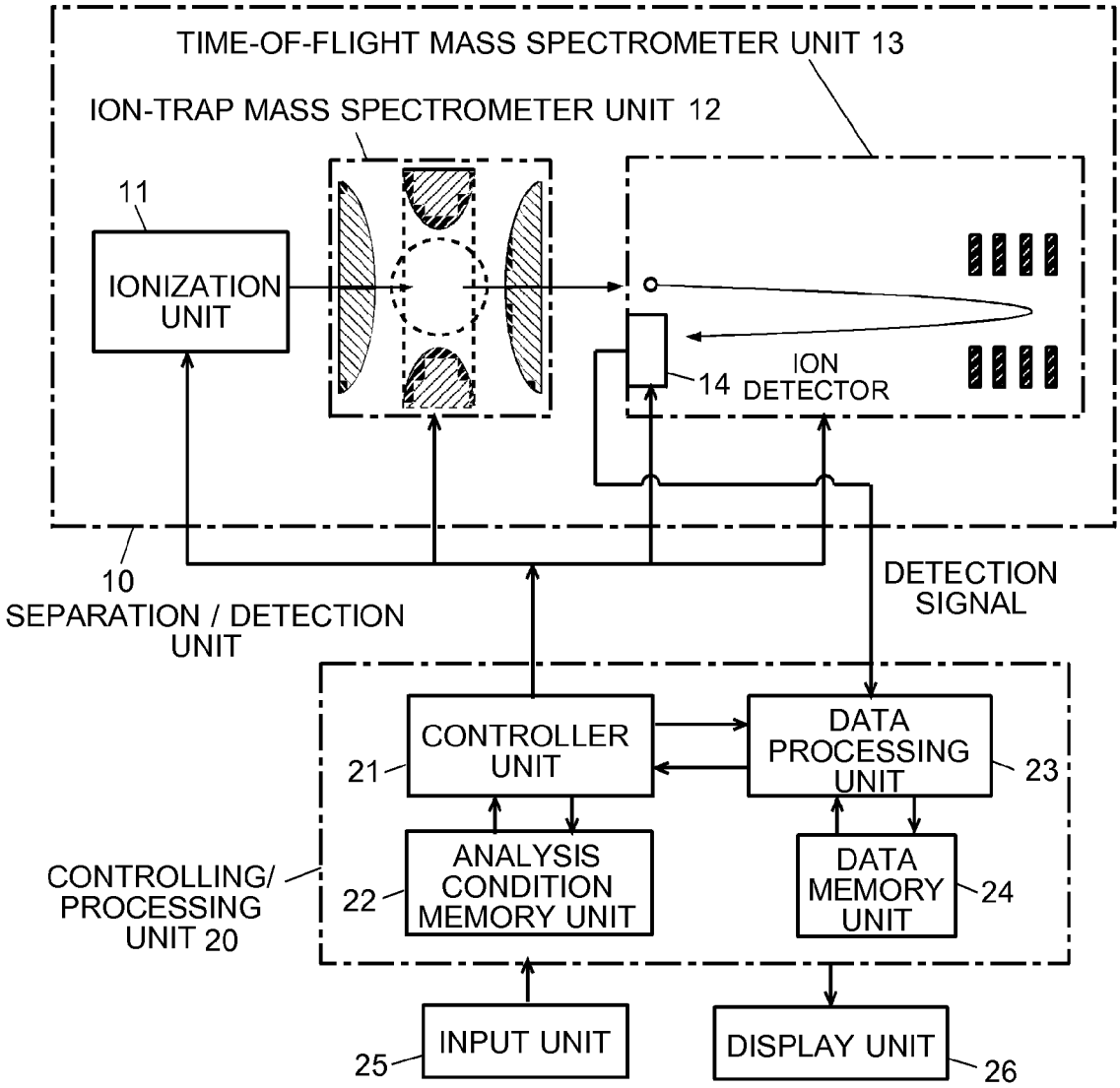
FIG. 1 is a schematic configuration diagram of a mass spectrometer according to an embodiment of the present invention.

FIG. 1 is a schematic configuration diagram of the mass spectrometer according to the present embodiment. As illustrated in FIG. 1, the mass spectrometer according to the present embodiment is roughly composed of two units; a separation/detection unit 10 and a controlling/processing unit 20. The separation/detection unit 10 includes: an ionization unit 11 for ionizing a sample liquid to be analyzed whose components were separated by a liquid chromatograph for example by an electrospray ionization (ESI) method; a three-dimensional quadrupole ion-trap mass spectrometer unit 12 having a function for selecting an ion with a predetermined mass (m/z value) as a precursor ion and making the precursor ion CID-dissociate to generate product ions; a time-of-flight mass spectrometer unit 13 for temporally separating the introduced ions according to their mass; and an ion detector 14 for sequentially detecting the separated ions.

The controlling/processing unit 20 includes: a controller unit 21 for controlling each section of the separation/detection unit 10; an analysis condition memory unit 22 for preliminarily memorizing various analysis conditions for performing an analysis; a data processing unit 23 for performing a predetermined analytical process by converting a detection signal from the ion detector 14 into digital data and subsequently processing the data; and a data memory unit 24 for memorizing the data obtained by an analysis. An input unit 25 for allowing the analyst to perform various kinds of inputs, settings or directions, and a display unit 26 for displaying analysis conditions, analysis results or other information are connected to the controlling/processing unit 20. In general, the controlling/processing unit 20 is realized by a commercially available personal computer. Executing a dedicated controlling/processing software program installed in the computer accomplishes the characteristic operations as will be described later. In this case, the input unit 25 is a keyboard and/or mouse or similar pointing device. Of course, it is possible to use a built-in computer especially designed for this application, rather than use a general-purpose personal computer.

Next, a typical analytical procedure using the mass spectrometer according to the present embodiment will be explained in reference to FIGS. 2 through 5. Although the mass spectrometer according to the present embodiment is capable of repeating an ion species' selection/dissociation operation any number of times in the ion-trap mass spectrometer unit 12, in the example explained below, the analysis is performed until n=3 in this invention, i.e. until an $MS^3$ analysis.

Figure 2:
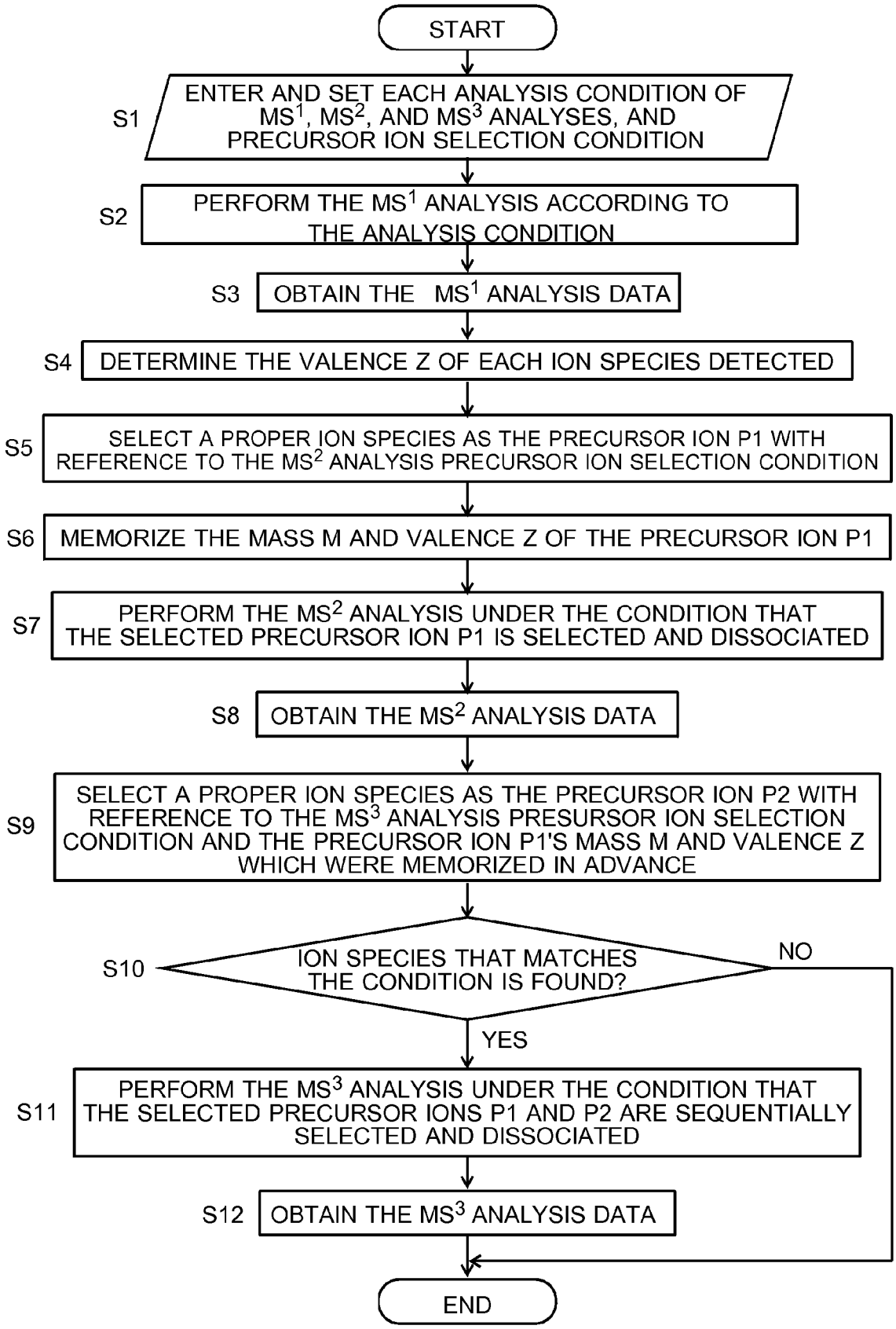
FIG. 2 is a flow chart of the operations with a focus on the controller/processor when an $MS^1$ analysis, $MS^2$ analysis and $MS^3$ analysis are automatically performed in the mass spectrometer according to the present embodiment.
Figure 3:
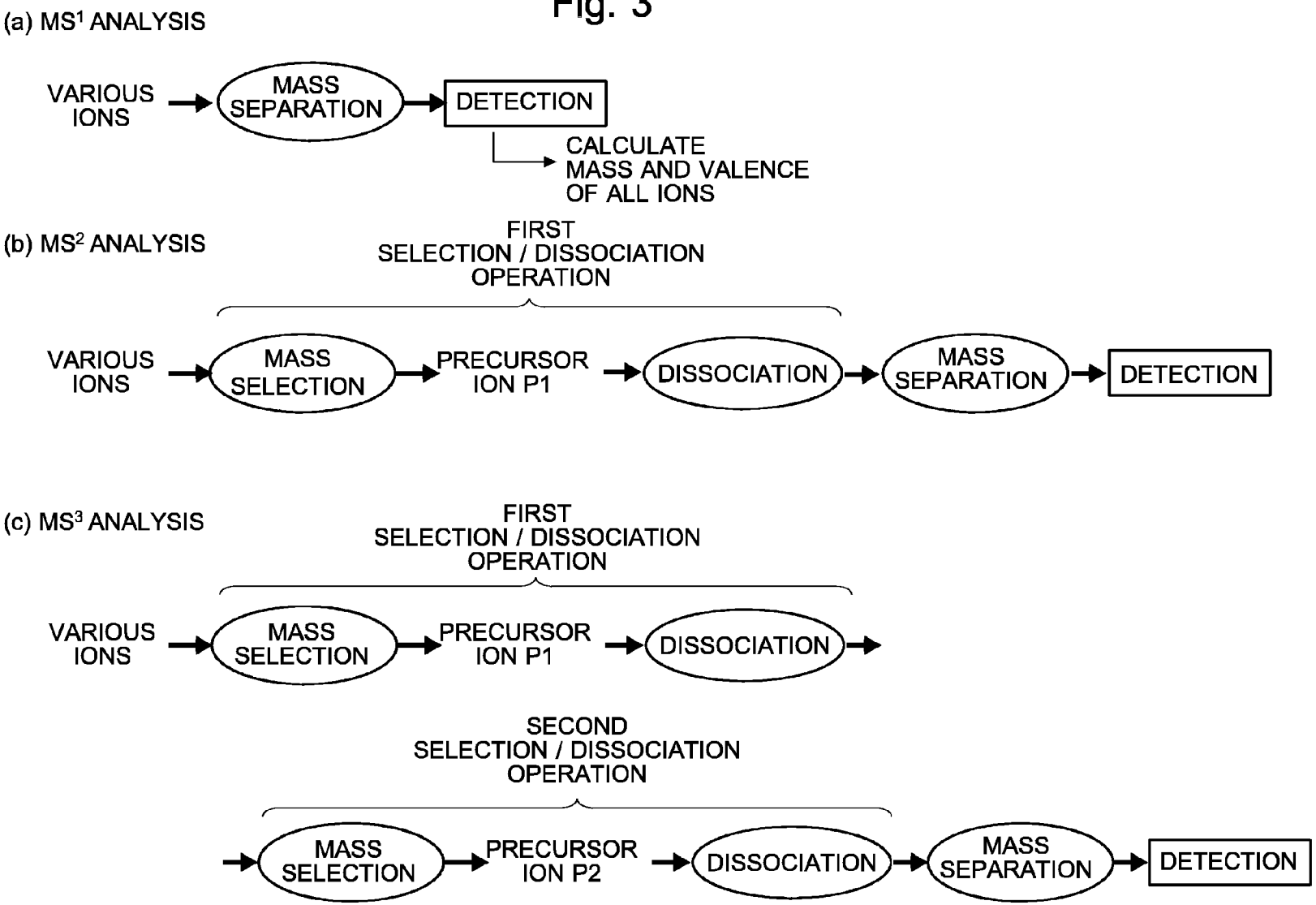
FIG. 3 is a pattern diagram summarizing the processes performed by the separator/detector in an $MS^1$ analysis, $MS^2$ analysis and $MS^3$ analysis in the mass spectrometer according to the present embodiment.
Figure 4:
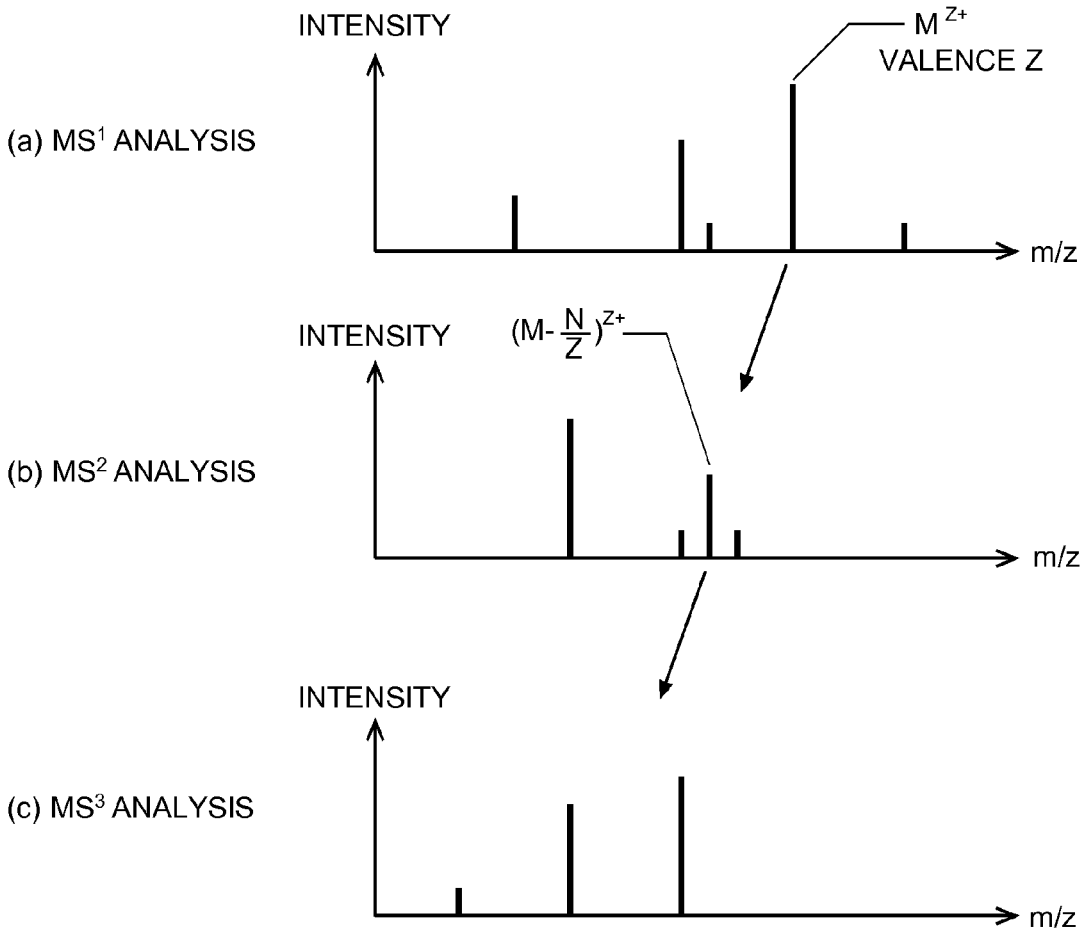
FIG. 4 is an example of a mass spectrum obtained by an $MS^1$ analysis, $MS^2$ analysis and $MS^3$ analysis in the mass spectrometer according to the present embodiment.
Figure 5:
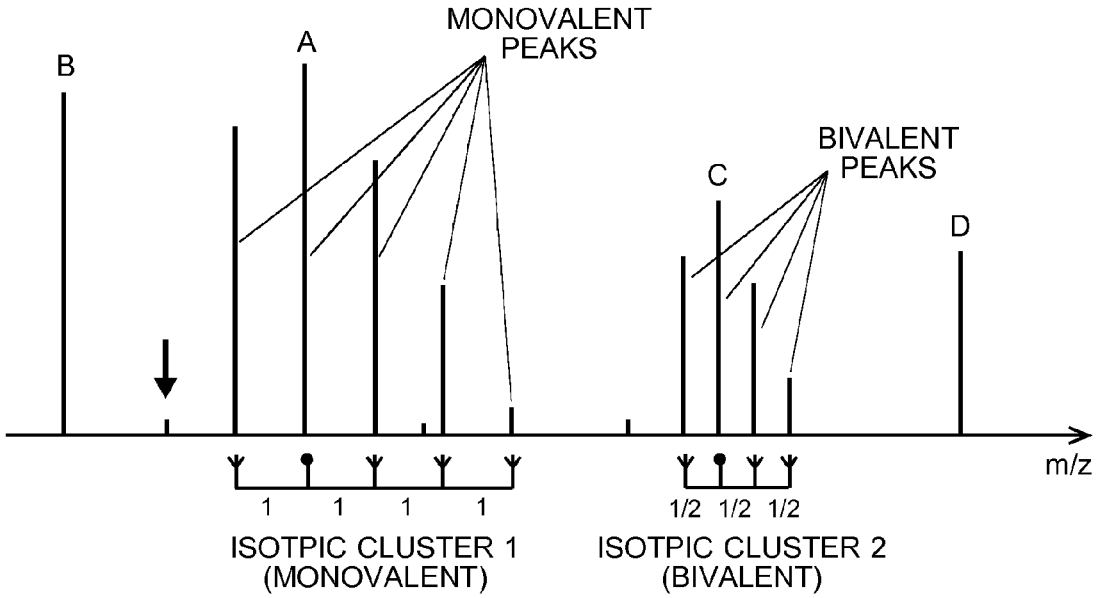
FIG. 5 is a conceptual diagram for explaining a valence determining operation performed in the process of an automatic analysis in the mass spectrometer according to the present embodiment.

FIG. 2 is an operational flowchart with a focus on the controlling/processing unit 20 when an MS analysis (hereinafter, described as $MS^1$ analysis for clarifying that it is a part of a series of automatic analyses), MS/MS analysis (hereinafter described as $MS^2$ analysis), and $MS^3$ analysis are automatically performed in the mass spectrometer according to the present embodiment. FIG. 3 is a pattern diagram summarizing the processes or operations performed in the separation/detection unit 10 in each of these analyses. FIG. 4 is an example of a mass spectrum expressed by the analysis data obtained in each of these analyses. FIG. 5 is a conceptual diagram for explaining a valence determining operation performed in the process of this analysis.

First, prior to the automatic analysis, the analyst (user) sets the analysis conditions such as an ionization method and measuring mass range, regarding the $MS^1$ analysis, $MS^2$ analysis and $MS^3$ analysis. Simultaneously, as for the $MS^2$ analysis and $MS^3$ analysis, each of which is accompanied with the selection/dissociation process, the analyst sets the selection references for the automatic selection of the precursor ion for each stage from the input unit 25 (Step S1). The precursor ion selection reference for the $MS^2$ analysis is for determining the ion intensity (peak's signal intensity) and the mass, and is generally and conventionally known. Meanwhile, the precursor ion selection reference for the $MS^3$ analysis is some kind of information on the fragments desorbed in the $MS^2$ analysis; specifically, the mass of the fragment is numerically entered or the composition formula of the fragment is entered.

In the case where a composition formula is entered, it is preferable that a list of many composition formulas previously registered be displayed on the display unit 26 so that the analyst can select a desired composition formula from among those with a mouse or other devices rather than enter alphanumeric characters through the input unit 25. This saves trouble for analyst and lessens inputting errors. In any case, when a composition formula is entered, the composition formula is converted to a mass inside the controller unit 21. The analysis conditions and precursor ion selection references entered as previously described are memorized in the analysis condition memory unit 22.

When an automatic analysis is initiated under the control of the controller unit 21, the controller unit 21 first makes the mass spectrometer units 12 and 13 operate under the analysis conditions for $MS^1$ stored in the analysis condition memory unit 22 and obtains the $MS^1$ analysis data (Steps S2 and S3). Specifically, in the ion-trap mass spectrometer unit 12, the ion's selection or dissociation operation are not carried out, but the ions generated in the ionization unit 11 are just temporarily stored and the ions stored are introduced all together into the time-of-flight mass spectrometer unit 13. The ions are then separated according to their mass by the time-of-flight mass spectrometer unit 13 and are sequentially detected by the ion detector 14, as shown in FIG. 3(*a*). The $MS^1$ analysis data obtained by this is, for example, the data showing a mass spectrum illustrated in FIG. 4(*a*). This MS analysis data is stored in the data memory unit 24. The data processing unit 23 determines, based on the MS analysis data, the valence Z of each ion species corresponding to the peaks appearing the mass spectrum (Step S4).

The determination method of the ion species' valence could be chosen from one of many; for example, it is possible to use the method that the applicant of the present application has already proposed in Japanese Patent Application No. 2005-141845. At this point, this method is roughly explained using FIG. 5. With this method, the peak pattern's matching within an isotopic cluster is determined to identify the isotopic cluster and determine the valence, where the isotopic cluster is a peak group consisting of a plurality of peaks which originate form ions having the same elemental composition yet have different m/z values depending on the difference of the isotopic composition of the ions. In the meanwhile, for the sake of simplicity, each peak in the mass spectrum illustrated in FIG. 4 is expressed with one peak which in detail is an isotopic cluster as illustrated in FIG. 5.

First the m/z value and peak intensity of each peak are determined from a mass spectrum as illustrated in FIG. 5. After this, a peak is chosen as a candidate for the standard peak, i.e. a peak that serves as a basis for searching for the pattern of an isotopic cluster according to a predetermined algorithm. In the case where a peak to serve as a standard peak is selected in order of descending peak intensity, the base peak (a peak having the highest intensity among the measured peaks: peak A in FIG. 5) is chosen as the standard peak in the first process. In the processes after the first process, any peak identified as a peak belonging to the isotopic cluster in the previous processes will be kept from being selected as a standard peak.

Next, the peak pattern around the standard peak is analyzed to determine whether or not the peak pattern corresponds to the emerging pattern of the peaks of any of the isotopic clusters having different valence numbers; the valence pattern matching is thus performed. The valence pattern matching is performed according to the conditions such as the range of valence for searching for an isotopic cluster, the tolerance for the resolution for searching for the peaks belonging to an isotopic cluster, and the minimum value of the peak number to be considered to comprise an isotopic cluster.

Specifically, the valence pattern matching includes the following steps: setting points at even intervals from the m/z value of the standard peak, the interval being determined for each isotopic cluster having a different valence number on the assumption that the isotopic cluster includes that standard peak; and checking whether or not a peak exists at each point. For example, if a standard peak is included in a monovalent isotopic cluster, the peaks belonging to the isotopic cluster show a peak pattern with their m/z values different by one valence from each other; therefore the interval for searching is one as illustrated by the isotopic cluster 1 in FIG. 5. If a standard peak is included in a bivalent isotopic cluster, the peaks belonging to the isotopic cluster show a peak pattern with their m/z values different by ½ valence from each other; therefore the aforementioned interval is ½ as illustrated by the isotopic cluster 2 in FIG. 5.

As for the peaks anterior to the standard peak, i.e. anterior peaks, a threshold of the relative intensity to the standard peak which is varied according to the mass value (the value of m/z value multiplied by an assumed valence Z) of the standard peak is set. A peak with its intensity equal to or below the threshold is removed from the candidates for the peaks belonging to the isotopic cluster in the matching process. For example, although the peak indicated by the arrow in FIG. 5 matches the peak pattern of the monovalent isotopic cluster which includes the standard peak A, its relative intensity to the standard peak A is below the threshold; therefore, it is determined as a noise to be removed from the candidates for the peaks belonging to the isotopic cluster 1. In addition, maximum and minimum intensity values for the matching are determined according to the relative intensity to a neighboring peak that has already been identified as belonging to the isotopic cluster, and any peaks having the intensity out of the maximum and minimum intensity values are removed from the candidates for the isotopic cluster peak.

In the valence pattern matching, isotopic cluster valence patterns that have matched the peak pattern around the standard peak are sequentially searched, and an isotopic cluster valence pattern having the highest matching resolution (i.e. the standard deviation of the difference between the measured value and the predicted value in searching for each peak belonging to an isotopic cluster) is selected to identify the true isotopic cluster. Then the valence of the valence pattern selected is determined as the valence of each peak belonging to the identified isotopic cluster. This is an example of the valence determining operation in Step S4.

Returning back to FIG. 2, the explanation is carried on. In the data processing unit 23, an appropriate ion species is automatically selected as a precursor ion P1 from a plurality of ion species obtained through the $MS^1$ analysis, with reference to the precursor ion selection reference for the $MS^2$ analysis which is stored in the analysis condition memory unit 22 (Step S5). In the case where, for example, the precursor ion selection reference for the $MS^2$ analysis is set to be an ion species corresponding to the peak having the highest signal intensity among the observed ion species' peaks, $M^{Z+}$ ion in the $MS^1$ analysis data illustrated in FIG. 4(*a*) is selected as precursor ion P1. Since the valence of each ion species has been obtained by the determination process as previously described, if a certain ion species is selected as the precursor ion P1, the mass M and valence Z of the precursor ion P1 are defined. Then the controller unit 21 temporarily memorizes the information on the mass M and valence Z of the precursor ion P1 in its internal memory (Step S6).

After the aforementioned process regarding the $MS^1$ analysis is completed, the controller unit 21 makes the mass spectrometer units 12 and 13 operate under the analysis conditions that the precursor ion P1 which was automatically selected in advance is selected and dissociated, to obtain the $MS^2$ analysis data (Steps S7 and S8). Specifically, in the ion-trap mass spectrometer unit 12, all the ion species generated in the ionization unit 11 are once captured, and then the ion species other than the precursor ion P1 are eliminated, i.e. the precursor ion P1 is mass-selected. The precursor ion P1 left in the ion trap is CID-dissociated and then various product ions generated by the dissociation are all together introduced into the time-of-flight mass spectrometer unit 13. Then, these ions are separated according to their mass by the time-of-flight mass spectrometer unit 13 and are sequentially detected by the ion detector 14, as shown in FIG. 3(*b*). The $MS^2$ analysis data obtained by this is, for example, the data showing the mass spectrum illustrated in FIG. 4(*b*). The $MS^2$ analysis data is also stored in the data memory unit 24.

In the analysis condition memory unit 22, as the precursor ion selection reference for the $MS^3$ analysis, mass N of a fragment which has been desorbed in the $MS^2$ analysis (strictly speaking, in the first selection/dissociation operation of the $MS^2$ analysis) is set. The data processing unit 23 searches for the ion species having the mass of M−(N/Z) among the ion species corresponding to the peaks appearing in the mass spectrum obtained form the $MS^2$ analysis and selects it as the subsequent precursor ion P2, using the information of the mass N and the information of the mass M and valence Z of the precursor ion P1 in the $MS^2$ analysis which were temporarily stored in advance (Step S9). In the example of FIG. 4(*b*), the valence of the precursor ion P1 is Z, and a peak corresponding to the ion species having the mass of M−(N/Z) is observed in the mass spectrum. Therefore, this ion species is selected as the precursor ion P2 which serves as a target of the second selection/dissociation operation of the subsequent $MS^3$ analysis.

Depending on the precursor ion selection reference or other conditions, however, ion species that matches the condition cannot always be found. Hence, whether or not the ion species that matches the condition has been found is determined (Step S10), and in the case where the ion that matches the condition has not been found, the controlling/operation regarding this automatic analysis is terminated without performing the subsequent $MS^3$ analysis. Alternatively, in the case where the ion that matches the condition has not been found, the $MS^3$ may be performed in accordance with predetermined other conditions, e.g. the ion corresponding to the peak having the strongest signal intensity among the peaks observed in the mass spectrum obtained from the $MS^2$ analysis is set as the precursor ion P2.

In the case where the ion that matches the condition is found and selected as the precursor ion P2 in Step S10, the controller unit 21 subsequently makes the mass spectrometer units 12 and 13 operate under the condition that the two precursor ions which have been automatically selected in advance are sequentially selected and dissociated, and obtains the $MS^3$ analysis data, where the two precursor ions are the precursor ion P1 serving as a target in the first selection/dissociation process and the precursor ion P2 serving as a target in the second selection/dissociation process (Steps S11 and S12).

Specifically, in the ion-trap mass spectrometer unit 12, all the ion species generated in the ionization unit 11 are once captured, and then the ion species other than the precursor ion P1 are eliminated, i.e. mass-selected. The precursor ion P1 selectively left in the ion trap is CID-dissociated and among various product ions generated by the dissociation, the ion species other than the precursor ion P2 are eliminated from the inside of the ion trap, i.e. mass-selected. After that, the precursor ion P2 which was selectively left in the ion trap is CID-dissociated once more, and various product ions generated by the dissociation are all together introduced into the time-of-flight mass spectrometer unit 13. Then the product ions are separated according to their mass by the time-of-flight mass spectrometer unit 13 and are sequentially detected by the ion detector 14, as shown in FIG. 3(*c*).

The $MS^3$ analysis data obtained by this is, for example, the data showing the mass spectrum illustrated in FIG. 4(*c*). The $MS^3$ analysis data is also stored in the data memory unit 24. In this embodiment, this $MS^3$ analysis data is eventually provided and supplied to the analyst.

As just described, in the mass spectrometer according to the preset embodiment, the $MS^1$ analysis, $MS^2$ analysis, and $MS^3$ analysis are sequentially and automatically performed with the sequential selection of a precursor ion based on the conditions which the analyst has set in advance. Then, the result of the $MS^3$ analysis is provided. During this process, the analyst is not required to perform any judgment or entering operation regarding the selection of precursor ions, hence troublesome and complicated operations for selecting a precursor ion are greatly lightened. In addition, since the valence of each ion species obtained by the mass analysis is automatically determined and the precursor ion in consideration thereof is selected, an ion with its desorbed fragment having a predetermined mass is certainly selected even in the case where the ion is not monovalent but multivalent. Hence, it is possible to obtain the important information for the analysis of the chemical structure or the like.

In the aforementioned explanation, the valences of the precursor ions P1 and P2 are not considered to change in the $MS^1$ analysis and $MS^2$ analysis because it is premised on the neutral loss in which neutral fragments without charge are desorbed by a CID dissociation. On the premise that not a neutral loss but a desorption in which the valence may change, it is possible to add a process of determining the valence of each ion observed based on the $MS^2$ analysis data. That is, the same process as the valence's determination process performed in Step S4 may be added after Step S8 in the flowchart of FIG. 2. The valence's information obtained through this may preferably be used for the selection of the precursor ion P2.

In the embodiment described earlier, the analysis is performed until the $MS^3$ analysis which is accompanied with two stages' selection/dissociation operations in an automatic analysis. However, it is obvious that the present invention may be extended to the multiple-stage $MS^n$ analysis in which $n \geqq 4$. In fact, the more the repeat count of the selection/dissociation operation becomes, the more complicated the manual selection operation of the precursor ion becomes; therefore, the effect of decreasing the analyst's effort and improving the analytical efficiency according to the automatic selection of the precursor ion by the present invention further increases.

In the embodiment described earlier, the present invention is applied to an ion-trap time-of-flight mass spectrometer. However, the separation/detection unit 10 is not specifically limited to any type as long as it is possible to select/dissociate the ion species in multiple stages, and possible to mass-separate the ion finally generated through a dissociation. The ionization method by the ionization unit 11 is also not specifically limited to any method.

It should be noted that the aforementioned embodiment is an example of the present invention and any change, modification, or addition properly made within the scope of the present is also covered within the scope of the claims of the present invention.

The invention claimed is:

1. A mass spectrometer capable of an $MS^n$ analysis ($n \geqq 3$), comprising:

a) an input section configured to allow an analyst to enter and set a mass difference or information corresponding thereto between a precursor ion in an $(n-2)^{th}$ ion species' selection/dissociation operation and product ions created thereby, as a selection reference for a precursor ion of an $(n-1)^{th}$ ion species' selection/dissociation operation;

b) a valence determiner configured to determine a valence of at least one of selected precursor ions;

and c) a precursor ion selector configured to search for an ion species adapted to the selection reference entered and set through the input section, when performing an $MS^n$ analysis, in consideration of a valence determined by the valence determiner as to one of previous precursor ions, from among ion species corresponding to a peak appearing in a mass spectrum obtained by an $MS^{n-1}$ analysis, and then to determine the ion species as a precursor ion of an $(n-1)^{th}$ ion species' selection/dissociation operation in the $MS^n$ analysis.

2. The mass spectrometer according to claim 1, wherein the input section is configured to allow the analyst to numerically enter a mass of a fragment desorbed in the (n−2)th ion species' selection/dissociation operation, as the selection reference for a precursor ion of the (n−1)th ion species' selection/dissociation operation.

3. The mass spectrometer according to claim 1, wherein the input section is configured to allow the analyst to enter a composition formula of a fragment desorbed in the $(n-2)^{th}$ ion species' selection/dissociation operation, as the selection reference for a precursor ion of the $(n-1)^{th}$ ion species' selection/dissociation operation, and the mass spectrometer further comprises a converter configured to calculate a mass of the fragment from the composition formula entered and set through the input section.

4. The mass spectrometer according to claim 3, wherein the input section is configured to allow the analyst to select one from among a plurality of previously registered composition formulas.

5. The mass spectrometer according to claim 1, wherein the input section is configured to allow the analyst to select a name of a fragment desorbed in the $(n-2)^{th}$ ion species' selection/dissociation operation from among a plurality of previously registered names, as the selection reference for a precursor ion of the $(n-1)^{th}$ ion species' selection/dissociation operation, and the mass spectrometer further comprises a converter configured to calculate a mass of the fragment from the name entered and set through the input section.

6. The mass spectrometer according to claim 2, wherein the precursor ion selector is configured to search for an ion species having a mass of M−(N/Z) among the ion species corresponding to peaks appearing in the mass spectrum obtained by the $MS^{n-1}$ analysis, where N is the mass of the fragment, and M and Z are the mass and valence of the precursor ion selected for the $MS^{n-1}$ analysis, respectively.

7. The mass spectrometer according to claim 3, wherein the precursor ion selector is configured to search for an ion species having a mass of M−(N/Z) among the ion species corresponding to peaks appearing in the mass spectrum obtained by the $MS^{n-1}$ analysis, where N is the mass of the fragment, and M and Z are the mass and valence of the precursor ion selected for the $MS^{n-1}$ analysis, respectively.

8. The mass spectrometer according to claim 1, wherein the valence determiner is configured to determine the peak pattern's matching within an isotopic cluster to identify the isotopic cluster and determine the valence, the isotopic cluster consisting of a peak group consisting of a plurality of peaks which originate from ions having a same elemental composition yet have different m/z values depending on a difference of an isotopic composition of the ions.

9. A mass spectrometer capable of an $MS^n$ analysis ($n \geqq 3$), comprising:

a) an input section configured to allow an analyst to enter and set a mass difference or information corresponding thereto, and a valence difference or information corresponding thereto between a precursor ion in an $(n-2)^{th}$ ion species' selection/dissociation operation and a product ion created thereby, as a selection reference for a precursor ion of an $(n-1)^{th}$ ion species' selection/dissociation operation;

b) a valence determiner configured to determine a valence of an ion species corresponding to a peak appearing in a mass spectrum obtained by an analysis; and c) a precursor ion selector configured to search for an ion species adapted to the selection reference entered and set through the input section, when performing an $MS^n$ analysis, in consideration of each of valences determined by the valence determiner as to a precursor ion and product ions in an $(n-2)^{th}$ ion species' selection/dissociation operation, from among ion species corresponding to a peak appearing in a mass spectrum obtained by an $MS^{n-1}$ analysis, and then to determine the ion species as a precursor ion of an $(n-1)^{th}$ ion species' selection/dissociation operation in the $MS^n$ analysis.

10. The mass spectrometer according to claim 9, wherein the input section is configured to allow the analyst to numerically enter a mass and a valence of a fragment desorbed in the $(n-2)^{th}$ ion species' selection/dissociation operation, as the selection reference for a precursor ion of the $(n-1)^{th}$ ion species' selection/dissociation operation.

11. The mass spectrometer according to claim 9, wherein the input section is configured to allow the analyst to enter a composition formula and a valence or an ionic formula of a fragment desorbed in the $(n-2)^{th}$ ion species' selection/dissociation operation, as the selection reference for a precursor ion of the $(n-1)^{th}$ ion species' selection/dissociation operation, and the mass spectrometer further comprises a converter configured to calculate a mass and a valence of the fragment from information entered and set through the input section.

12. The mass spectrometer according to claim 11, wherein the input section is configured to allow the analyst to select one from among a plurality of previously registered composition formulas and ionic formulas accompanied with valence.

13. The mass spectrometer according to claim 9, wherein the input section is configured to allow the analyst to select a name of a fragment desorbed in the $(n-2)^{th}$ ion species' selection/dissociation operation from among a plurality of previously registered names, as the selection reference for a precursor ion of the $(n-1)^{th}$ ion species' selection/dissociation operation, and the mass spectrometer further comprises a converter configured to calculate a mass and a valence of the fragment from the name entered and set through the input section.

14. The mass spectrometer according to claim 10, wherein the precursor ion selector is configured to search for an ion species having a mass of M−(N/Z) among the ion species corresponding to peaks appearing in the mass spectrum obtained by the $MS^{n-1}$ analysis, where N is the mass of the fragment, and M and Z are the mass and valence of the precursor ion selected for the $MS^{n-1}$ analysis, respectively.

15. The mass spectrometer according to claim 11, wherein the precursor ion selector is configured to search for an ion species having a mass of M−(N/Z) among the ion species corresponding to peaks appearing in the mass spectrum obtained by the $MS^{n-1}$ analysis, where N is the mass of the fragment, and M and Z are the mass and valence of the precursor ion selected for the $MS^{n-1}$ analysis, respectively.

16. The mass spectrometer according to claim 9, wherein the valence determiner is configured to determine the peak pattern's matching within an isotopic cluster to identify the isotopic cluster and determine the valence, the isotopic cluster consisting of a peak group consisting of a plurality of peaks which originate from ions having a same elemental composition yet have different m/z values depending on a difference of an isotopic composition of the ions.

* * * * *